United States Patent [19]

Tuenge et al.

[11] Patent Number: 5,072,152

[45] Date of Patent: Dec. 10, 1991

[54] HIGH BRIGHTNESS TFEL DEVICE AND METHOD OF MAKING SAME

[75] Inventors: Richard T. Tuenge, Hillsboro; Christopher N. King, Portland, both of Oreg.

[73] Assignee: Planar Systems, Inc., Beaverton, Oreg.

[21] Appl. No.: 474,949

[22] Filed: Feb. 5, 1990

[51] Int. Cl.[5] ..... H05B 33/12; H05B 33/10

[52] U.S. Cl. ..... 313/509; 313/116; 427/66

[58] Field of Search ..... 313/509, 116; 427/66

[56] References Cited

U.S. PATENT DOCUMENTS

| | | | |
|---|---|---|---|
| 4,020,389 | 4/1977 | Dickson et al. | 313/509 X |
| 4,675,092 | 6/1987 | Baird et al. | 204/192.26 |
| 4,728,581 | 3/1988 | Kane et al. | 313/503 X |
| 4,774,435 | 9/1988 | Levinson | 313/509 |

FOREIGN PATENT DOCUMENTS

| | | | |
|---|---|---|---|
| 15689 | 2/1979 | Japan | 313/509 |

*Primary Examiner*—Palmer C. DeMeo

*Attorney, Agent, or Firm*—Chernoff, Vilhauer, McClung & Stenzel

[57] ABSTRACT

A TFEL device for producing a high brightness output comprises a substrate supporting a laminar thin film stack including a front electrode layer and a rear electrode layer sandwiching an electroluminescent laminate comprising an electroluminescent layer sandwiched by a pair of insulating layers. A thin film insulating layer is grown by evaporation on the glass substrate and produces a surface having a degree of roughness which is replicated by the remaining thin film layers. The surface contour at the interfaces between each of the thin film layers is convoluted which reduces internal light reflection and provides more light output at the front of the panel.

6 Claims, 1 Drawing Sheet

HIGH BRIGHTNESS TFEL DEVICE AND METHOD OF MAKING SAME

BACKGROUND OF THE INVENTION

The following invention relates to a method and a structure for increasing the brightness of display panels using thin film electroluminescent (TFEL) devices.

TFEL panels are flat display screens which incorporate a thin film electroluminescent layer sandwiched by a pair of insulating layers and first and second electrode layers for producing a visible light output in the presence of an electric field generated by the electrode layers. Examples of such devices are shown in U.S. Pat. No. 4,719,385 "Multi-Colored Thin Film Electroluminescent Display," Jan. 12, 1988. The thin films that generate light in these devices are generally deposited on a substantially planar substrate such as glass, as shown in FIG. IA. The light emitting component is a phosphor film such as ZnS:Mn which may be formed by either evaporation or sputtering. For some phosphors such as ZnS:Tb sputtering is necessary in order to achieve the proper chemical composition of the thin film. A sputtered film, however, has a very smooth surface.

A phosphor film, typically, has a very high index of refraction which results in a small critical angle of reflection. If $\theta_c$ is the critical angle then sin $\theta_c$ equals n'/n where n' is the index of refraction of the medium outside the phosphor and n is the phosphor index of refraction. ZnS, for example, has a high index of refraction of 2.34. If n' is defined as the index of refraction of air (1.00) then the critical angle turns out to be 25.3°. This means that most of the light impinging on the front of the device is lost due to internal reflection. This internal reflection results in light actually being piped out of the edges of the device which substantially reduces its luminance. Theoretically, for perfectly planar surfaces only 10% of the light actually emerges from the front.

Increasing the surface roughness of the thin films helps to alleviate this problem. However, it turns out that sputtered films have a flatter surface morphology than, for example, evaporated films. It is much more economical, however, to form the electroluminescent phosphor film by sputtering.

In the past, various approaches have been taken to increase the surface roughness of the films and thereby reduce the amount of light that is lost due to internal reflection. One such approach is shown in Levinson U.S. Pat. No. 4,774,435 in which the substrate is roughened by chemical etching, mechanical abrading or some other technique so that the topography of the substrate is replicated by the thin film layers which are later deposited. The same approach is used in Kane, et al., U.S. Pat. No. 4,728,581 where the electrodes first deposited on the substrate have a textured surface which propagates through the overlying layers. The problem with both of these approaches is that the devices become less reliable. Using the Kane approach, rough points on the transparent ITO conductor tend to pierce the insulating layers and cause destructive electrical breakdown. Also, high local electric fields are produced by the sharp crystalline facets of the roughened ITO which contribute to insulator breakdown. With the display disclosed in Levinson, the degree of surface roughness can become so high that tears and voids appear in the electrode layer ultimately causing breakdown. Also, modification of the glass substrate generates defects and causes trapped contamination on the surface of the glass, both of which later contribute to device failure.

SUMMARY OF THE INVENTION

The present invention provides a method and apparatus for reducing internal light reflection in a TFEL device and includes the process of forming a thin film insulating layer by evaporation on a transparent planar substrate, depositing a thin transparent electrode layer on top of the thin film insulating layer, placing a thin film laminate electroluminescent structure on top of the thin transparent electrode layer, and placing a rear electrode layer on top of the thin film laminate electroluminescent structure.

The thin film insulating layer is formed by evaporation to create a surface roughness that is replicated by the remaining layers. Evaporation works best but other deposition processes may also produce a surface having the requisite degree of roughness. Ideally the degree of roughness of the thin film insulating layer should be on the same order of magnitude as the wave length of light emitted by the electroluminescent laminate. For example, for green light emitted by a ZnS:Tb phosphor, the necessary degree of surface roughness is on the order of 1000Å, which is the degree of roughness that results from evaporating ZnS on a glass substrate. When this method is used, the phosphor layer in the thin film laminate electrominescent structure may be deposited by sputtering. The roughness of the insulating layer will be replicated by both the electrode layers and the electroluminescent laminate to produce distorted or convoluted surfaces at the interfaces between all layers, and thus scatter the light outwardly of the panel without losses due to internal reflection. The rough thin film insulating layer may be formed from any insulating material which may be grown by evaporation. A preferred material is ZnS, although any insulator may be used.

It is a principal object of this invention to provide a TFEL panel having a high degree of brightness by eliminating losses of light caused by internal reflection.

A further object of this invention is to provide a high brightness TFEL panel where the electroluminescent phosphor layer may be formed by sputtering.

A still further object of this invention is to provide a distorted surface for the thin films of a TFEL device to reduce internal reflection without the attendant problems of electrical breakdown and device failure caused by internal contamination.

BRIEF DESCRIPTION OF THE DRAWINGS

FIG. a side cutaway view of a typical TFEL device.

DETAILED DESCRIPTION OF THE INVENTION

Figure 1A:
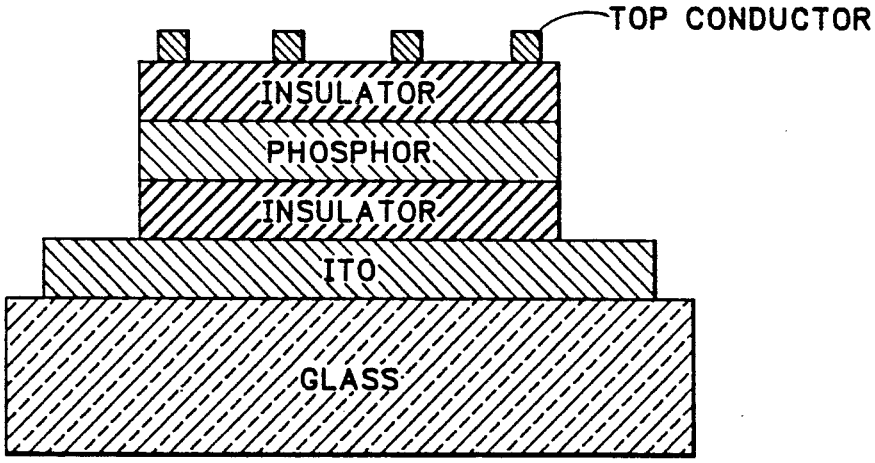
FIG. 1B is a side cutaway view of a TFEL device made according to the process of the invention.
Figure 1B:
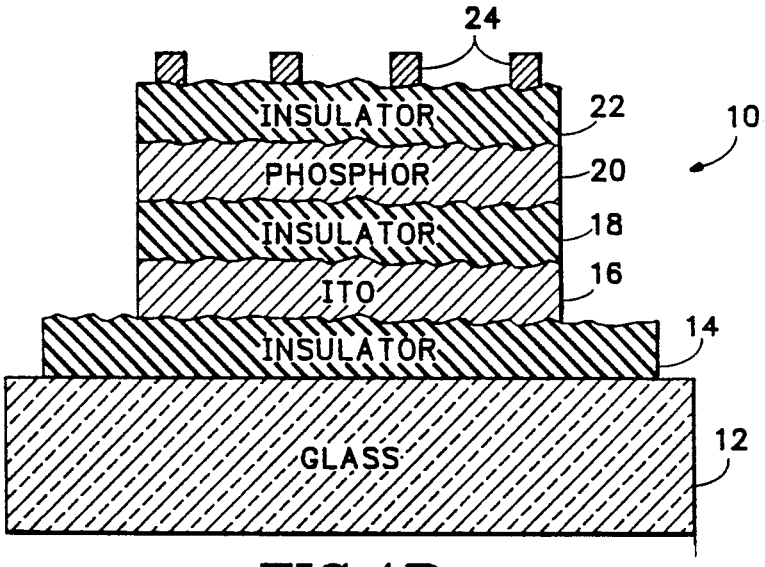

A thin film TFEL device 10 comprises a glass substrate which is generally planar with thin film and electrode layers placed on top of it. A thin insulating layer 14 is formed by evaporation on the surface of the glass substrate 12 to produce a distorted or contoured surface having a degree of roughness which is on the same order of magnitude as the wave length of light emitted by the device 10. A transparent indium tin oxide (ITO) layer 16 is deposited atop the insulating layer 14. A TFEL laminate comprising a phosphor layer 20, which may be formed by sputtering, is sandwiched between insulators 22 and 18 and placed atop the ITO layer 16. The ITO layer 16 and the TFEL laminate comprising layers 18, 20 and 22 will replicate the surface morphology of the evaporated insulating layer 14 and the ITO layer so that the interfaces between adjacent layers ar roughened. A rear electrode layer comprising conductors 24 is placed atop insulating layer 22.

Figure 2:
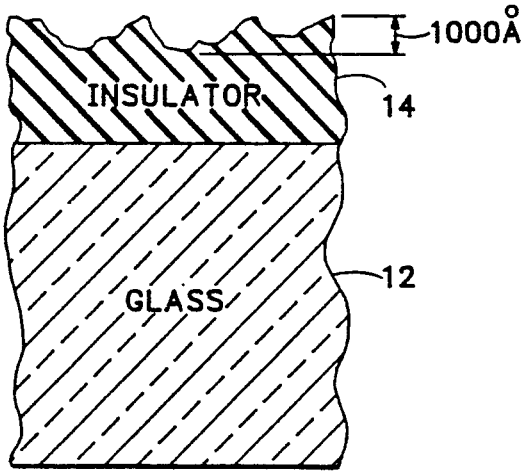
FIG. 2 is an expanded partial side cutaway view of a portion of the device of FIG. 1.

As shown in FIG. 2, when the insulating layer 14 is formed by evaporation, it produces a surface morphology which is rough and contorted. The surface roughness of this layer is the average distance between the peaks and valleys in the surface left by the evaporation process. The two lines drawn, respectively, through the peaks and valleys of layer 14 are intended to represent the average distance between the peaks and valleys, and in the case of the example shown in FIG. 2 that distance is 1000Å. This is on the same order of magnitude as a wave length of visible light. In the example shown, the phosphor layer 20 is ZnS:Tb which produces a green light emission.

The growth morphology of the evaporated ZnS film tends to produce a diffuse reflectivity of 10% compared with the diffuse reflectivity of a sputtered ZnS film which is only 0.6%. The diffuse reflectivity is a measure of the film roughness since a film with purely planar surfaces and no internal grain structure would have zero diffuse reflectivity. Thus there is a major difference between the optical scattering characteristics of an evaporated thin film as opposed to a sputtered thin film. Using an evaporated film such as a layer of ZnS, nominally 7500Å in thickness, a template can be made which supports the remaining thin film layers of the EL device. The result of using the process described above is a device that has twice the brightness as one without the evaporated ZnS layer between the substrate and the ITO layer.

The terms and expressions which have been employed in the foregoing abstract and specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A method of fabricating a TFEL device comprising the steps of:

(a) forming a thin film insulating layer on a transparent planar substrate to create a roughened template surface;

(b) depositing a transparent electrode layer on top of said thin film insulating layer so as to conform to the roughened template surface;

(c) placing a thin film laminate electroluminescent structure on top of the transparent electrode layer so as to conform to the contour of the electrode layer; and (d) placing a rear electrode layer on top of the thin film laminate electroluminescent structure.

2. The method of claim 1 wherein the thin film insulating layer is formed by evaporation.

3. The method of claim 1 wherein the thin film insulating layer is ZnS.

4. The method of claim 1 wherein the thin film laminate includes an electroluminescent layer formed by sputtering.

5. The method of claim 2 wherein the surface roughness of the thin film insulating layer is approximately 1000Å.

6. A thin film electroluminescent device comprising:

(a) a planar substrate;

(b) a thin film stack comprising a front transparent electrode layer and a rear electrode layer sandwiching an electroluminescent laminate comprising a layer of electroluminescent phosphor film sandwiched between a pair of insulating layers; and (c) a transparent thin film insulating layer deposited by evaporation on said substrate between said stack and said substrate and having a surface roughness of approximately 1000Å which is substantially replicated by said thin film stack for reducing internal light reflection.

* * * * *

UNITED STATES PATENT AND TRADEMARK OFFICE

CERTIFICATE OF CORRECTION

PATENT NO. : 5,072,152

DATED : December 10, 1991

INVENTOR(S) : Richard T. Tuenge et al.

It is certified that error appears in the above-identified patent and that said Letters Patent is hereby corrected as shown below:

Col. 2, Line 54: after FIG. insert --1A is--

Signed and Sealed this

Fourteenth Day of September, 1993

*Attest:*

*Attesting Officer*

BRUCE LEHMAN

*Commissioner of Patents and Trademarks*